US006711854B1

(12) United States Patent
Andersen

(10) Patent No.: US 6,711,854 B1
(45) Date of Patent: Mar. 30, 2004

(54) CHILD SAFETY BARRIER WITH PLATE-SHAPED MEMBER FOR DISPLAYING INFORMATION, PICTURES OR MOUNTING OF ITEMS

(75) Inventor: Finn Andersen, Ry (DK)

(73) Assignee: Baby Dan A/S, Låsby (DK)

( * ) Notice: Subject to any disclaimer, the term of this patent is extended or adjusted under 35 U.S.C. 154(b) by 0 days.

(21) Appl. No.: 09/701,866

(22) PCT Filed: Jun. 14, 1999

(86) PCT No.: PCT/DK99/00324

§ 371 (c)(1),
(2), (4) Date: Dec. 21, 2000

(87) PCT Pub. No.: WO99/66164

PCT Pub. Date: Dec. 23, 1999

(30) Foreign Application Priority Data

Jun. 17, 1998 (DK) ..... 1998 00853

(51) Int. Cl.[7] ..... E06B 11/02
(52) U.S. Cl. ..... 49/57; 49/50; 49/55
(58) Field of Search ..... 49/50, 55, 57; 40/611, 308, 299.01, 584

(56) References Cited

U.S. PATENT DOCUMENTS 903,564 A * 11/1908 Haben ..... 49/55
1,116,942 A * 11/1914 Smith ..... 40/604
1,123,930 A * 1/1915 Ryan ..... 160/105
2,864,189 A * 12/1958 Campbell ..... 40/308
3,964,197 A * 6/1976 Tucker et al. ..... 40/584
4,240,549 A * 12/1980 Hogg ..... 206/303
4,685,247 A * 8/1987 Alam ..... 49/55
4,702,036 A * 10/1987 Johnson ..... 49/55
4,866,866 A * 9/1989 Rotter et al. ..... 40/610
5,272,840 A * 12/1993 Knoedler et al. ..... 49/463
5,307,580 A * 5/1994 Farmer ..... 40/607.03
5,363,575 A * 11/1994 Sawyer et al. ..... 40/308
5,367,829 A * 11/1994 Crossley et al. ..... 49/465
5,396,732 A * 3/1995 Andersen ..... 49/55
5,402,988 A * 4/1995 Eisele ..... 256/24
5,437,115 A * 8/1995 Freese et al. ..... 49/465
5,442,881 A * 8/1995 Asbach et al. ..... 49/465
5,829,505 A * 11/1998 Brescia ..... 160/225
5,906,068 A * 5/1999 Bode ..... 49/55
5,924,242 A * 7/1999 Macari et al. ..... 49/55

* cited by examiner

*Primary Examiner*—Gregory J. Strimbu
(74) *Attorney, Agent, or Firm*—Dykema Gossett PLLC

(57) ABSTRACT

A child safety barrier for temporary blocking of openings in buildings, typically door openings, stairways and windows, includes a plurality of vertical lattice bars (7) extending between upper and lower cross members (5, 6) the barrier (1) being provided with at least a plate-shaped section (17, 19, 20, 24) for displaying information, pictures or items and being attachable to the lattice bars and/or the cross members.

7 Claims, 3 Drawing Sheets

CHILD SAFETY BARRIER WITH PLATE-SHAPED MEMBER FOR DISPLAYING INFORMATION, PICTURES OR MOUNTING OF ITEMS

BACKGROUND OF THE INVENTION

1. Field of the Invention

The present invention relates to a child safety barrier or lattice for temporary blocking of openings in buildings, typically door openings, opening, the barrier including a plurality of lattice bars which extend between upper and lower cross members.

2. The Prior Art

Barriers of this type are known, e.g., from the applicant's U.S. Pat. No. 5,396,732, wherein a door is provided in one side of the barrier. The barriers may also be provided with a central door, as is known, e.g., from U.S. Pat. No. 4,685,247. A somewhat different structure is known from U.S. Pat. No. 2,928,146 which, in contrast to the two preceding patents, is not based on a frame which is secured in the opening.

In case of child safety barriers which block the children's view, e.g. like the barrier of WO 93/05262, of the surroundings at the back of the barrier where various activities may take place which the children can hear and smell, the children have a natural urge to explore this. At the same time the children are aware that the barrier can be passed, since they see the older children and the adults do so. Attempts at forcing the barrier subject it to maximum loads, which, of course, it is desired to avoid to the greatest extent possible.

It is different with child safety barriers having an open lattice structure, here the children can directly see what is going on on the other side of the barrier. But here too the children can stress the barrier to some degree, e.g. by playing through the barrier with older children on the other side thereof.

The object of the invention, in case of child safety barriers having an open lattice structure, is to reduce children's desire to force them. It is also desired that this can take place without interfering with the basic structure of the barrier, and without this weakening it, while additionally satisfying safety standards. If possible, it is desirable that the solution may also be used in connection with existing barriers.

SUMMARY OF THE INVENTION

The object is achieved according to the invention in that the barrier is provided with at least one plate-shaped section for units, e.g. with information, pictures, mirrors, baby alarms, music boxes, etc., said section being arranged to be secured in connection with the lattice bars and/or the cross members. This furnishing of the barrier with activity sections reduces children's urge to try to force the barrier. Hereby, the stability of the barrier in emergency situations will be intact to a higher degree, as it has not been subjected to so many loads. In addition, the structure interferes as little as possible with the integrity of the barrier, and the section may moreover be shaped so as to allow replacement of the objects. It is evident that the sections may be shaped so that they may be subsequently mounted on existing barriers.

In a special embodiment, the section is provided in that the upper cross member or the lower cross member is formed with an eye-shaped opening for insertion of an object. With this solution in particular it is important that the upper cross member of the barrier maintains the mechanical strength or has even become stronger.

Preferably, the eye-shaped opening is symmetrical about a horizontal line, which is an advantage in terms of production. This solution is particularly suitable in connection with the lower cross member.

Another possible embodiment is that the eye-shaped opening is formed by a horizontal extent of the cross member and a curved element which extends therefrom. The curved element may extend above the cross member or below it. The former has the advantage that the lattice bars have the same length.

In another embodiment the plate-shaped element covers an area which replaces a plurality of lattice bars. This provides for an element which is larger than the distance between two lattice bars.

In a special embodiment, the plate-shaped element is transparent with pictures placed on parts of the element. This diverts children's attention from what is going on on the other side of the barrier, while providing a more personal aesthetic impression depending on the picture.

The plate elements may be attached between the lattice bars in different ways. In one embodiment this may take place in that the plate-shaped element is secured between two lattice bars, and that the side edges of the plate-shaped element are concave for receiving the lattice bars. Alternatively, the plate-shaped element may be secured between two lattice bars, the lattice bars being compressed to concave faces for receiving the element.

In another embodiment attachment means may be arranged on the upper and lower cross members in the area with the plate-shaped element for additional attachment and stabilization of the element.

In a special embodiment, these may be formed by crescents with pins for receiving a corresponding hole in the plate-shaped element.

The invention will be described more fully below with reference to the accompanying drawings, which show various embodiments.

Figure 1:
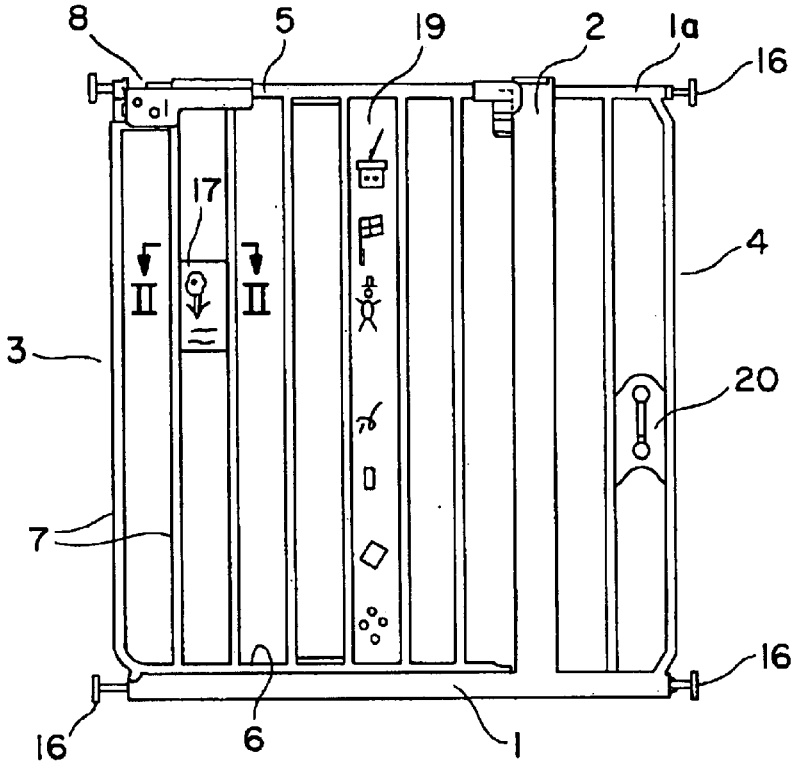
FIG. 1 shows a child barrier according to the invention, seen from the side, FIGS. 2A and 2B, which are views along line II—II of FIG. 1, show alternative constructions of the plate-shaped element and the lattice bars for connection thereof.

The child barrier shown in the drawings is specially intended for insertion into door frames or stairways and includes a frame formed of a lower beam 1, a vertical post 2 which extends upwardly from the lower beam, an upper beam 1*a* which extends from the post in parallel with lower beam 1, and lattice bars 4 which extend between the upper beam 1*a* and the lower beam 1. A door 3 is hinged to the post, the door comprising an upper cross member 5 and a lower cross member 6 between which a plurality of lattice bars 7 extend. A closing mechanism 8 is arranged at the front upper corner of the door and is intended for cooperation with the lateral boundary of the passage. The child barrier is secured as a unit in the opening by means of ferrules 16 in the lower bar and at the top in the upper beam 1*a* and may be fixed against the sides of the passage. However, it should be noted that the idea may be applied to other types of barriers which are used in connection with the blocking of passages (door openings, staircases, etc.).

Figure 2A:
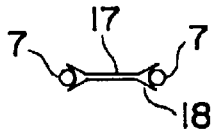
Figure 2B:
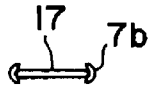

A section 17 is inserted between two adjacent lattice bars. The side edges 18, which are thicker than the rest of the plate-shaped section expediently made of plastic, are concave for receiving-the lattice bars, as seen in FIG. 2A. The width of the section is adapted so that the section is a press fit between the two lattice bars, without these being bent noticeably, however. Alternatively, as shown in FIG. 2B, the lattice bars 7*b* may be compressed so as to form a concave face between which the section may be arranged.

Instead of a small delimited section like 17, it may be arranged in the entire height of the door, cf. position 19. The section may here also rest on the cross-members, The ends of the section may be given an arbitrary shape as shown at position 20.

Figure 3:
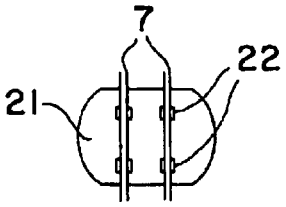
FIG. 3 shows a view of a plate-shaped element connected to two lattice bars using clips.
Figure 4:
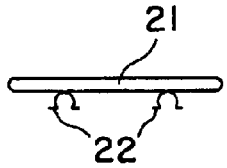
FIG. 4 shows the embodiment of FIG. 3 seen from above.
Figure 5:
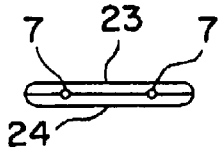
FIG. 5 shows top view of a third construction of plate-shaped element attached to two lattice bars.
Figure 6:
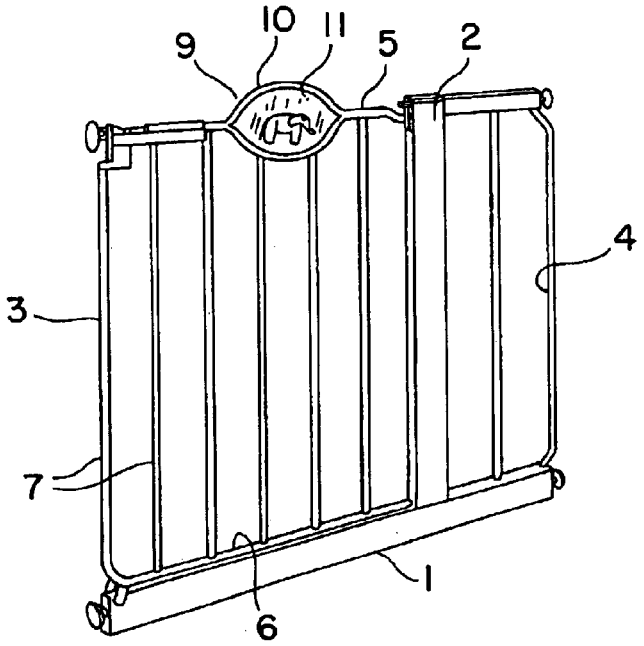
FIG. 6 shows a perspective view of another embodiment of child barrier according to the invention.

An alternative way of securing a section is shown in FIGS. 3 and 4. Here, the section 21 is secured to the lattice bars 7 with clips 22. As a result, the section may readily extend past the bars, as can be seen. This is also possible with the solution shown in FIG. 2A, if one side of the section is moved past the lattice bars. Another solution to the attachment is shown in FIG. 5, in which the section consists of two half-shells 23, 24 which are clamped together around the lattice bars. The section will hereby have a uniform appearance on each side of the barrier in a way similar to the solution shown in FIGS. 1 and 2, and not with front and rear sides proper like in the solution shown in FIGS. 3 and 4.

Figure 9:
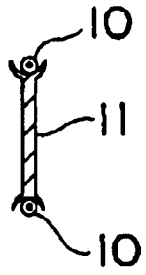
FIG. 9 shows a cross-section in the barrier in the upper side of the door and at its centre.

An alternative way of arranging the sections is shown in FIGS. 6–9. The cross member 5 of the door here has a section 9 which is defined by two curved pipes 10 in the cross member, and in which a plate member 11 with various pictures or information may be placed. The plate may be made of plastic and is secured by clamping, as shown in FIG. 9, which shows a cross-section of the section. The edges of plate member are concave so that the surrounding bars are mounted therein.

Figure 7:
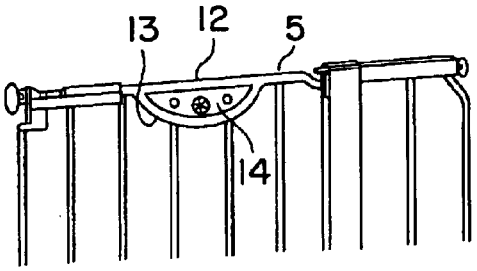
FIG. 7 shows a fragment of another embodiment of the upper edge of the barrier.
Figure 8:
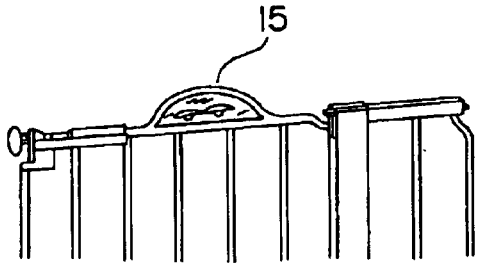
FIG. 8 shows a fragment of a further embodiment of the upper edge of the barrier.

Another embodiment in which the upper portion of the upper cross member of the door continues uninterruptedly in a straight pipe, is shown in FIG. 7 of the drawing. The section is formed here between the straight pipe 12 and a curved pipe 13 below it.

In addition to serving as a information carrier, the section may contain various other items, such as, e.g., a baby alarm 14 as shown in FIG. 7.

Figure 10:
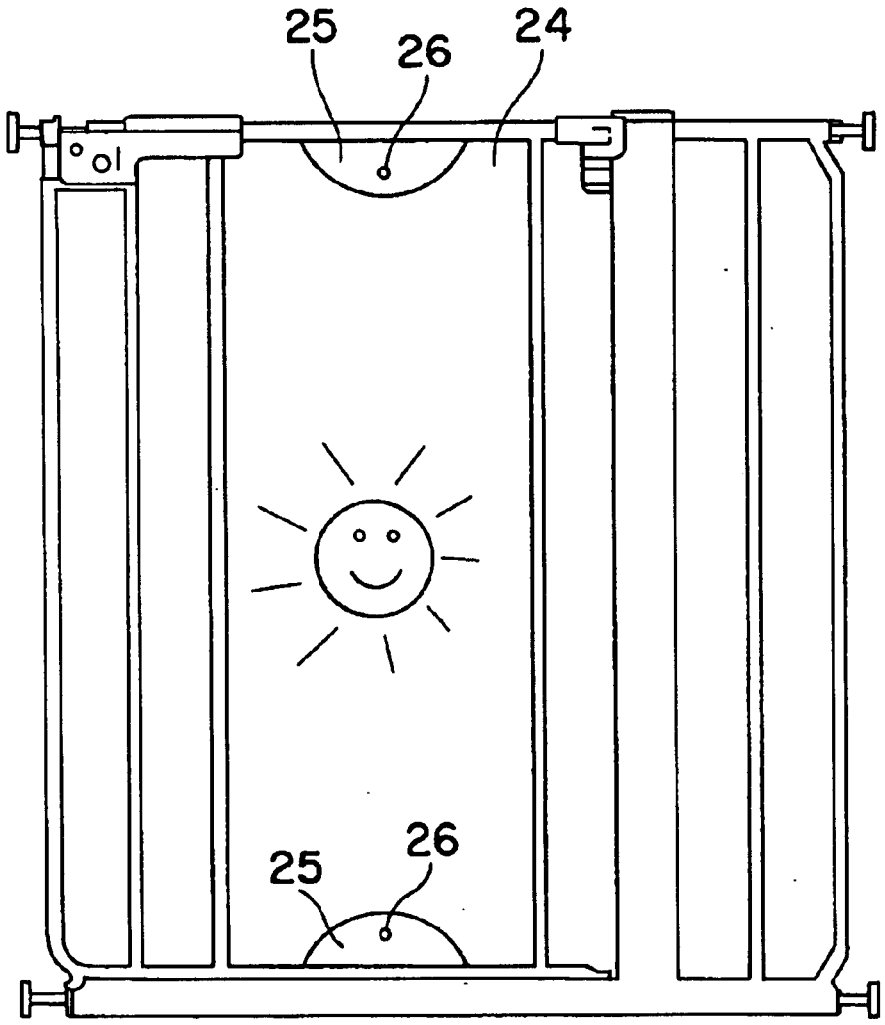
FIG. 10 shows a plate element which replaces individual lattice bars, placed between two lattice bars.

Another variation of the invention is shown in FIG. 10 which comprises a plate 24 that covers an area and thereby replaces lattice bars. The plate is again mounted between two lattice bars in one of the ways illustrated in the foregoing. To ensure that the plate is held in position between the two bars, two crescents 25 are arranged, the crescents 25 holding the central area of the plate. A hole is provided in the upper and lower parts of the plate which is pressed onto a pin 26 on the crescents. In one embodiment the crescents may be of metal or alternatively of plastics.

It will be appreciated that the sections may be given other geometrical shapes than those shown here, just as the sections may be varied in several ways, e.g. the section may carry a relief pattern. The plate member may also be secured in other ways than by the snap lock connection mentioned here, e.g. it may be screwed or riveted on.

What is claimed is:

1. A child safety barrier for positioning in an opening to block passage through the opening, said barrier comprising a frame which includes a lower beam, a vertical post, an upper beam and a plurality of vertical bars extending between the upper beam and the lower beam, and a door which is hinged to said vertical post to open and close the barrier, said door including an upper cross member, a lower cross member, a plurality of vertical lattice bars which extend between said upper and lower cross members, a plate-shaped member supporting at least one of information, pictures and mounted items and extending generally in coplanar alignment between two of said lattice bars and between said upper and lower cross members, said plate-shaped member including upper and lower mounting holes at respective upper and lower edges thereof, and means projecting from said upper and lower cross members for respectively attaching said plate shaped member thereto.

2. A child safety barrier according to claim 1, wherein said plate-shaped member comprises a transparent material and supports said pictures thereon.

3. A child safety barrier according to claim 1, wherein said frame include ferrules for mounting the barrier in the opening.

4. A child safety barrier according to claim 1, wherein said plate-shaped member extends from the upper cross member to the lower cross member of the door.

5. A child safety barrier according to claim 1, wherein said means for attaching said plate-shaped member to said door comprise pins projecting from said upper and lower cross members.

6. A child safety barrier according to claim 1, wherein said means for attaching said plate-shaped member to said door comprise crescent-shaped elements.

7. A child safety barrier according to claim 1, wherein said means for attaching said plate-shaped member to said door are each centrally positioned with respect to said upper and lower edges of said plate-shaped member.

* * * * *